US005303926A

United States Patent [19]

Owens et al.

[11] Patent Number: 5,303,926

[45] Date of Patent: Apr. 19, 1994

[54] MULTI-USE GOLF TRAINING DEVICE

[76] Inventors: Charles A. Owens, 7691 Oakmont Dr., Lake Worth, Fla. 33467; James A. Karr, III, 501 Lakewood Dr., Apt. 9B, Jupiter, Fla. 33458

[21] Appl. No.: 57,978

[22] Filed: May 7, 1993

[51] Int. Cl.[5] ..... A63B 69/36

[52] U.S. Cl. ..... 273/186.1; 273/190 R; 273/192

[58] Field of Search ..... 273/188 R, 188 A, 189 R, 273/189 A, 190 R, 190 A, 190 B, 191 R, 191 A, 191 B, 192, 186.1, 187.2; 248/125, 148, 150, 156, 161, 157, 218.4, 219.3, 225.31, 274, 528, 529, 530, 419, 420

[56] References Cited

U.S. PATENT DOCUMENTS

| | | | |
|---|---|---|---|
| 936,767 | 10/1909 | Van Eyck | 248/125 X |
| 1,414,771 | 5/1922 | Cantleberry | 248/125 |
| 2,562,021 | 7/1951 | Dotten | 248/156 X |
| 2,675,132 | 4/1954 | Susil | 248/125 X |
| 3,138,388 | 6/1964 | Herold | 273/188 R X |
| 3,326,558 | 6/1967 | Eaton, Jr. | 273/187.2 |
| 3,443,811 | 5/1969 | Brooks | 273/187.2 |
| 3,554,555 | 1/1971 | Macri | 273/195 X |
| 3,806,133 | 4/1974 | Cork | 273/192 |
| 4,225,104 | 9/1980 | Larson | 248/125 |
| 4,521,023 | 6/1985 | Williams | 273/190 R X |
| 4,659,084 | 4/1987 | Vuick | 273/190 R X |
| 4,758,000 | 7/1988 | Cox | 273/191 B X |
| 4,815,743 | 3/1989 | Meeker et al. | 273/190 R X |
| 4,927,152 | 5/1990 | Graham | 273/191 R X |
| 5,013,044 | 5/1991 | Hesselbart | 273/191 R X |

*Primary Examiner*—George J. Marlo
*Attorney, Agent, or Firm*—Cornelius J. Husar

[57] ABSTRACT

The disclosure relates to a portable golf swing practice device. The practice device includes a weighted base and an upstanding flute guide post with a positioning bar adjustably mounted between ear portions of a post encircling locking jaw which is vertically and rotatably adjustable on the guide post. By setting the positioning bar in any one of a plurality of positions relative to the user, each of the proper body positions and swing motions can be reinforced thus improving the user's stance and wring during actual playing. All components of the device are made of a rigid high strength polyvinylchloride to prevent corrosion.

10 Claims, 5 Drawing Sheets

MULTI-USE GOLF TRAINING DEVICE

BACKGROUND OF THE INVENTION

The instant invention relates to a golf training device and more particularly, it relates to a multi-use golf training device for improving one's golf swing, putting and chipping skills.

As anyone who has played the fascinating game of golf knows, in order for a golfer to execute a perfect swing, there are a multitude of factors that must be simultaneously considered and controlled to effect a good swing. A slight deviation in executing anyone of these many factors will result in a poor shot. For example, stance, hand grip, position of the head, straight left elbow, eye on the ball, backswing, forward swing and follow—through are some of the factors or facets to be kept in mind in order to successfully execute a good golf swing.

It is a well known theory that practice makes perfect, and in the golf game, the truth of this statement is more accurate than in many other instances. Since it is the repetitive conditioning of the body to go through certain motions, utilizing specific muscles and coordinating them in a particular manner which allows a good golf swing to be consistently executed in an efficient automatic manner and thus improve one's score.

Presently, there are numerous golf training devices on the market. However, many such known devices are limited to a single golfing facet, i.e. they are designed to control the golfer's stance, head position or putting strokes as set forth in U.S. Pat. Nos. 5,013,044 , 3,443,811 and 3,806,133, respectively. Other known golf training devices are very complex in nature as shown in U.S. Pat. Nos. 3,326,558 and 4,659,084. As can be seen from a review of these patents, there is a need for an uncomplicated, easy to use device such as the one developed by applicants.

SUMMARY OF THE INVENTION

In view of the above a noted deficiencies of the prior art, applicants have developed a multi-use golf training device which will serve to train the golfer in swing path, leg action, head position, chipping and putting. Applicants' novel device includes a ground engaging base, a vertical guide post and positioning bar that can be vertically adjusted as well as rotated about the vertical axis of the vertical guide post. Provision has also been made for adjusting the angle of inclination of the positioning bar. By allowing the angle of the positioning bar to be changed, applicants have provided a training aid for different facets such as preventing body sway on return of the forward swing when positioned on one side of the golfer's body next to the ear. When the positioning bar is positioned on the opposite side of the golfer's body, next to the ear, it serves to prevent body sway on the back swing. These are but a few of the many corrective measures which can be obtained through the use of applicants' novel device.

OBJECTS OF THE INVENTION

An object of the invention is to provide a golf training device which is inexpensive and provides a plurality of corrective measures to a golfer.

Another object of the invention is to provide a golf training device which can be used by golfers of all skill levels and still provide improved scores.

Yet another object of the invention is to provide a golf training device which is useful in improving a golfer's backswing, forward swing, follow-through, head position, chipping and putting skills.

A further object of the invention is to provide a golf training device which is lightweight and easy to use.

A still further object of the invention is to provide a golf training device which is adjustable and can accommodate golfers of different stature.

Yet another object of the invention is to provide a golf training device which is readily assembled and disassembled without the use of any special tools.

These and other objects of the instant invention will become more apparent hereinafter. The instant invention will now be described with particular reference to the accompanying drawings which form a part of the specification wherein like reference characters designate the corresponding parts in the several views.

DETAILED DESCRIPTION OF THE DRAWINGS

Figure 1:
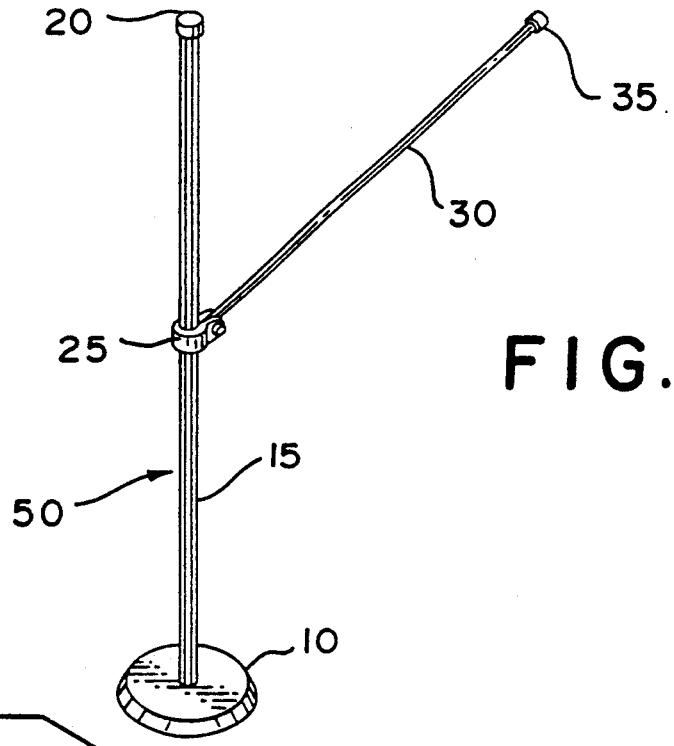
FIG. 1 is an elevational view of applicants' novel golf swing trainer.

Referring now to FIG. 1, there is illustrated an elevational view of applicants' novel device. As shown, it comprises a circular base 10 which receives vertical guide post 15 which is provided with a PVC cap 20 thereon. Secured to vertical guide post 15 is a nylon lockjaw 25 which is vertically and rotatably adjustable on vertical guide post 15. Extending outwardly from lockjaw 25 is positioning bar 30. As illustrated, positioning bar 30 is shown positioned slightly above true horizontal. The distal end of positioning bar 30 is also provided with a PVC cap 35. All the components, with the exception of base 10 and locking thumb bolt 26 and nut 26A, are made of PVC material. The reason for this particular selection of material is to reduce the overall weight and also for its resistance to corrosion characteristics. The vertical guide post 15 is made of three-quarter inch stock, while the positioning bar 30 is made of one-half inch stock material.

Figure 2:
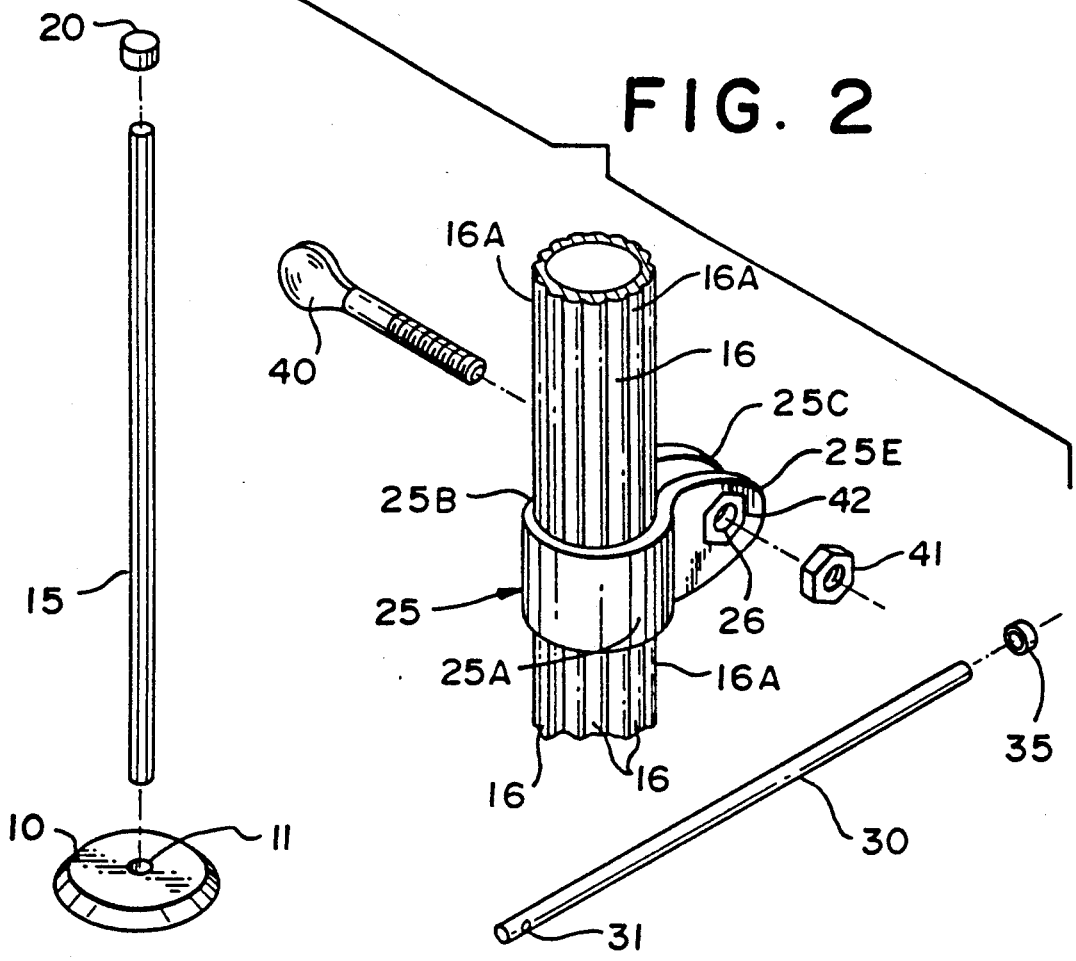
FIG. 2 is an exploded view illustrating the various components of the device in detail.

Turning now to FIG. 2, there is shown in exploded-view fashion, the individual components in greater detail. As illustrated, vertical guide post 15 is provided with a plurality of vertical flutes 16 which have been cut into the outer periphery thereof. Between adjacent flutes 16 are ribs 16A which is formed by the material remaining after flutes 16 were cut into guide post 15. The purpose of flutes 16 is to provide a better gripping action by lockjaw 25. Base 10 is approximately ten inches in diameter and is weighted to provide stability to vertical guide post 15. Base 10 includes a centrally located aperture 11 which receives the lowermost end of vertical guide post 15. Base 10 can be made of molded concrete or molded PVC with metallic weights imbedded therein. The purpose of weighting the base is to provide stability to the entire device.

Lockjaw 25 comprises a pair of half-members 25A and 25B which include an arcuate portion that conforms to the circumference of vertical guide post 15 and an extending ear portion 25E which includes a flat inner roughened ear portion 25C which serves as the clamping members for positioning bar 30 when inserted therebetween. Lockjaw halves 25A and 25B include aligned apertures 26 for receiving thumb bolt 40. Positioning bar 30 is provided with a locating aperture 31 through which thumb bolt 40 is inserted after positioning bar 30 is placed between lockjaw halves 25A and 25B. Although locknut 41 is shown spaced a distance from lockjaw half 25A, it is actually permanently attached to lockjaw half 25A by heat welding or other suitable attachment means as shown in dashed lines at 42. An end cap 5 is provided for the free end of positioning bar 30. Vertical guide post 15 is forty-eight inches high and positioning bar 30 is thirty-eight inches long.

As can be seen from the above description, applicants have provided a golf swing trainer device 50 which can be used for a multitude of swing motions. As indicated, positioning bar 30 is adjustably moveable vertically up and down vertical guide post 15. After the vertical position is set by the user, positioning bar 30 is then set in its desired position to enable the user to practice the desired swing position or corrective action to be taken. After deciding which swing is to be practiced and positioning bar 30 is located in the required position, thumb bolt 40 is tightened and lockjaws 25A and 25B are brought into tight engagement with ribs 16 which bite into lockjaw halves 25A and 25B. Then the user can begin his practice swings.

Figure 3:
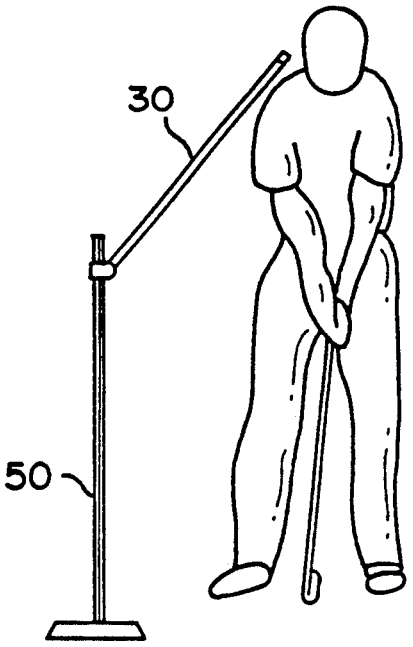
FIGS. 3 through 16 illustrate the various corrective positions which a golfer can assume utilizing applicants' novel device.

Turning now to FIGS. 3 through 16, there is shown in FIG. 3, the "HEAD BEHIND" position wherein the user is positioned behind the novel golf swing trainer 50 with positioning bar 30 placed at an angle above the user's right shoulder. With the user's head behind the free end of positioning bar 30. This position ensures that the head stays relatively still on the backswing.

Figure 4:
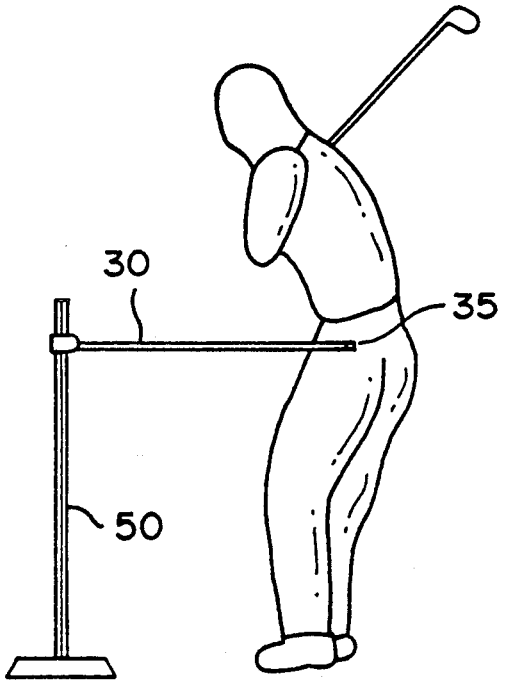

FIG. 4 illustrates the "FIX THE SLICE" position wherein the user is positioned with the golf swing trainer 50 in front of him with positioning bar 30 in a raised position and end cap 35 pointing toward the user's waist. This position keeps the hands working straight back on the take-away. It also ensures that the hands are working from the inside on the downswing.

Figure 5:
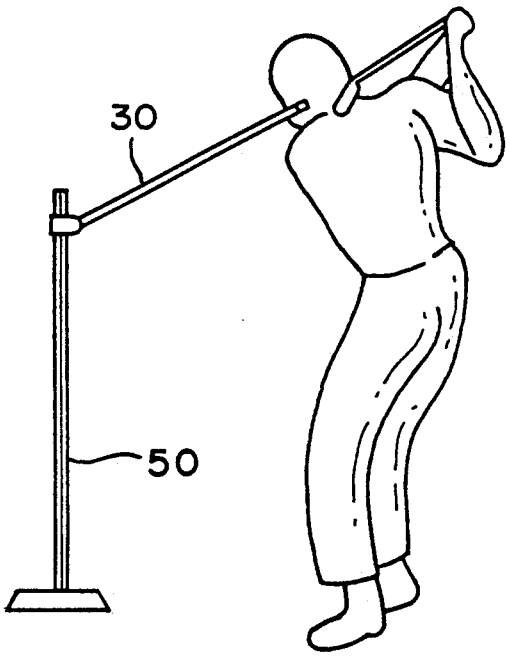

FIG. 5 illustrates the "HEAD IN FRONT" position wherein golf swing trainer 50 is positioned in front of the user and positioning bar 30 is positioned at an upward angle toward the user's left shoulder. This position ensures that the head stays behind the ball through impact.

Figure 6:
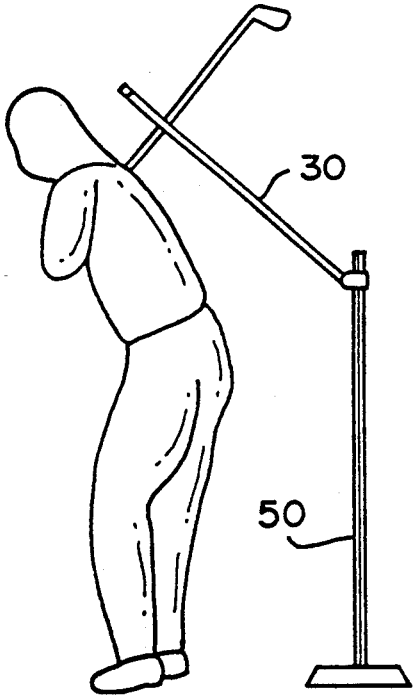

FIG. 6 illustrates the "UPRIGHT SWING" position. In this position the user stands in front of the practice device 50 with the positioning bar 30 raised at an angle toward his right shoulder. This position forces the golfer to make an upright swing.

Figure 7:
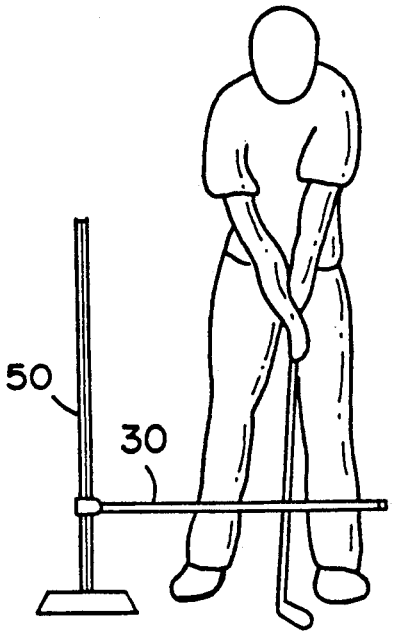

FIG. 7 illustrates the "ALIGNMENT" position wherein golf swing trainer 50 is positioned in front of the user with positioning bar 30 lowered and placed in a truly horizontal position. This position ensures that the user's body is aimed at the target.

Figure 8:
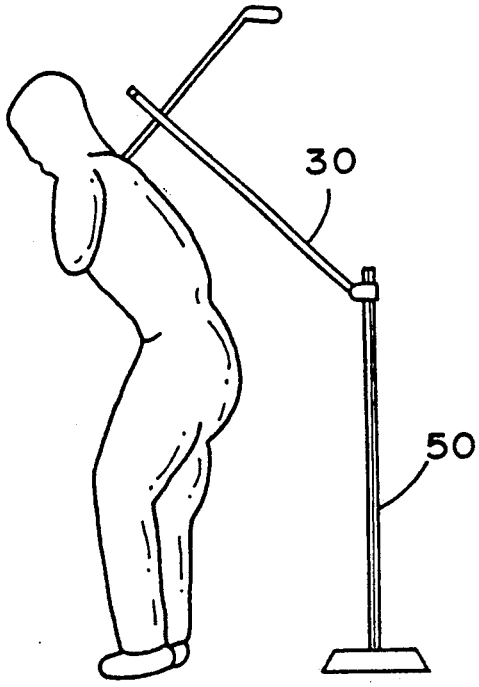

FIG. 8 illustrates the "SHORTEN THE BACKSWING" position. In this figure, golf swing trainer 50 is placed behind the user with positioning bar 30 inclined parallel to the user's back. This position makes certain that the user's backswing is the correct length.

Figure 9:
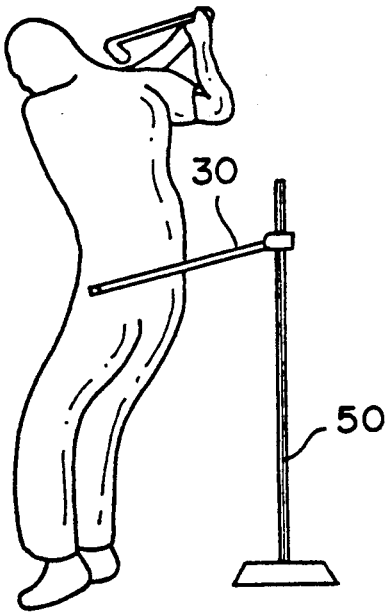

FIG. 9 illustrates the "HIPS" (SWAY BEHIND) position. In this figure, golf swing trainer 50 is placed behind the user with positioning bar 30 in a true horizontal position and raised to approximately the hip level of the user. This position makes sure the hips do not slide or sway on the backswing. It will keep the right leg firm.

Figure 10:
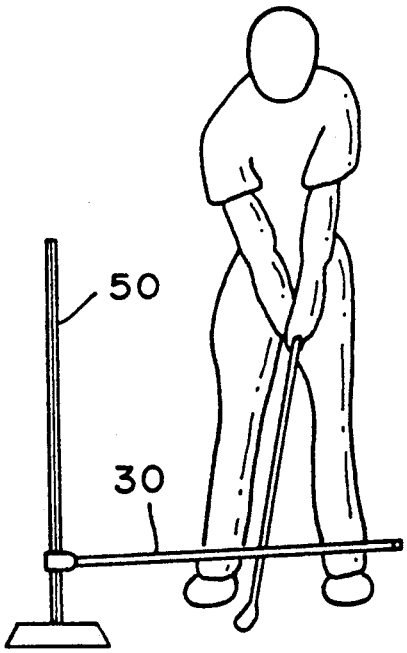

FIG. 10 illustrates the "PUTTING" position. In this figure, golf swing trainer 50 is placed in front of the user with positioning bar 30 lowered to a position slightly above the ground and extending across the front of the user. This position allows the user to keep this eyes directly on the target line when putting. It also teaches the user to keep the putter straight back and straight through.

Figure 11:
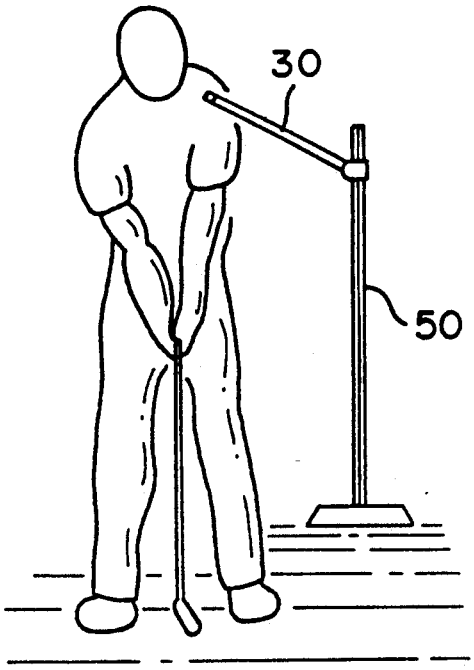

FIG. 11 illustrates the "FIX THE TURN" position. In this position, golf swing trainer 50 is located behind the left side of the user with positioning bar 30 inclined and positioned adjacent to the user's left shoulder. This position ensures that the shoulders turn around, behind the ball, on a shallow arch.

Figure 12:
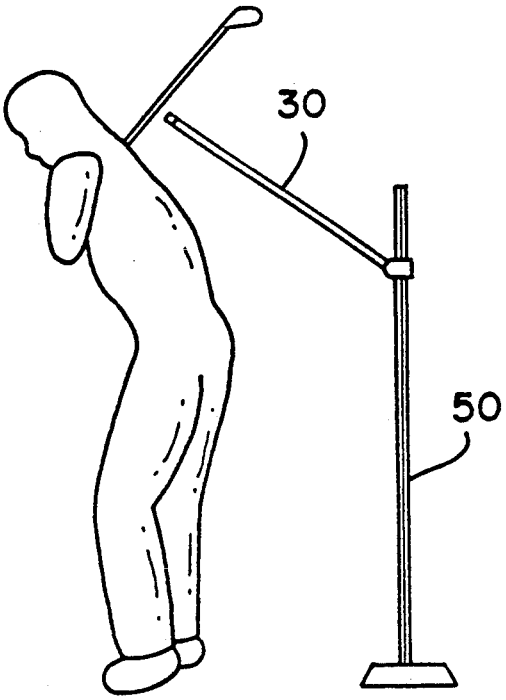

FIG. 12 illustrates the "MAINTAIN YOUR POSTURE" position. In this position, golf swing trainer 50 is located behind and to the right of the user. Positioning bar 30 is inclined toward the user's right shoulder. This position helps the spine maintain the same tilt from the beginning of th swing until the end.

Figure 13:
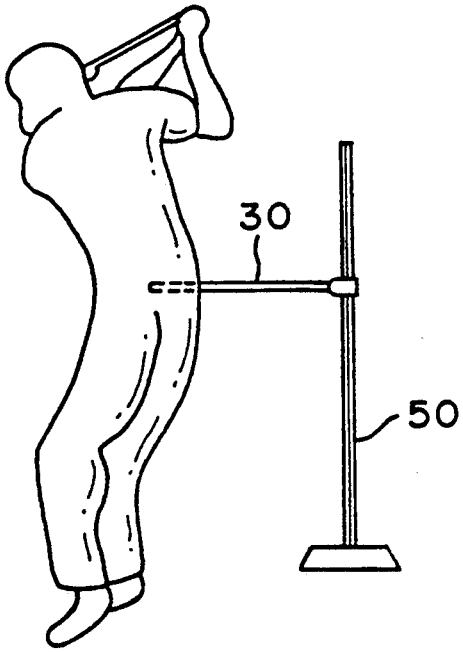

FIG. 13 illustrates the "HIPS" (IN FRONT) position. In this figure, golf swing trainer 50 is located to the right and rear of the user with positioning bar 50 in a true horizontal position with its free end adjacent to the user's right hip. This position creates a hip turn and not a slide to the left on the downswing.

Figure 14:
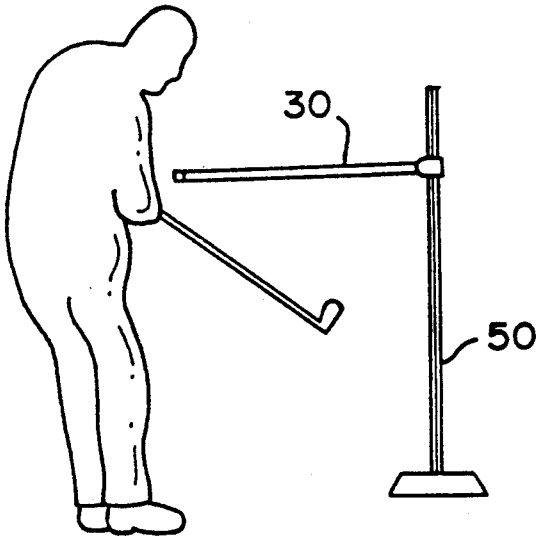

FIG. 14 illustrates the "FIX HOOK" position wherein golf swing trainer 50 is located to the right and front of the user with positioning bar 30 in a true horizontal position with the free end pointing toward the user. This position automatically makes the user's hips turn left through the impact so the hands will work left through the impact.

Figure 15:
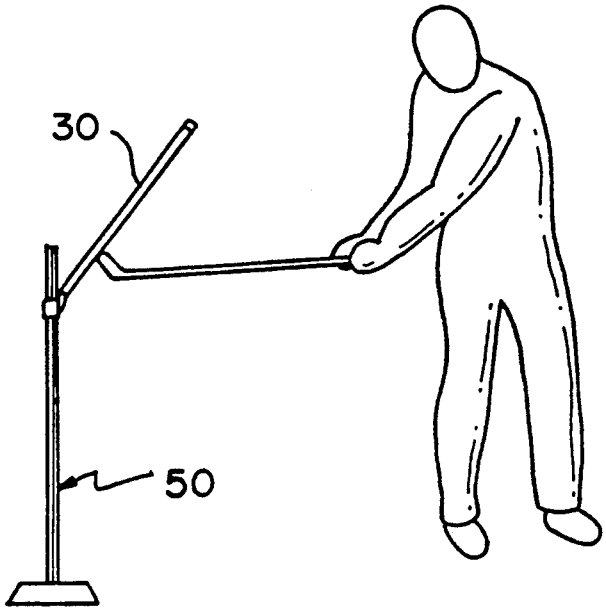

FIG. 15 illustrates the "WRIST BREAK" position wherein the golf swing trainer 50 is located to the right of the user with positioning bar 30 inclined toward the user. This position makes the user cock his wrist on the backswing, also it makes sure the wrists stay cocked on the downswing.

Figure 16:
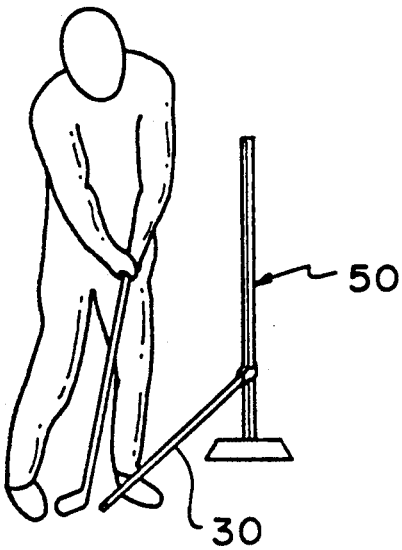

FIG. 16 illustrates the "CHIPPING" position wherein the golf swing trainer 50 is located to the left and behind the user with positioning bar 30 downward toward the ground. This position teaches the user to keep the wrists from breaking on a chip shot.

As can be seen from the above descriptions of the various figures, applicants have provided a golf swing trainer 50 which can be used to train the user in proper body position, gripping, head movement and control of the various muscles in carrying out the various swings. It has been discovered that through repeated practice swings using the golf swing trainer 50 the user will automatically control himself in like manner when out playing a round with his boss.

While the invention has been described in its preferred embodiment, it is to be understood that the words which have been used are words of description rather than words of limitation and that changes may be made within the purview of the appended claims without departing from the full scope of spirit of the invention.

Having described our invention, We claim:

1. A portable golf swing practice device for selectively executing any one of a plurality of golf swings, said device comprising:

having a centrally located aperture therein;

a vertically extending guide post having a first end received in said centrally located aperture;

said guide post having an outer circumferential surface that is provided with friction increasing means formed by a plurality of abutting flute extending the full length of said guide post;

locking jaw means having a first portion which engages said outer circumferential surface of said guide post;

said locking jaw means further including ear portions which project outwardly from said guide post;

a positioning bar adjustably mounted between said ear portions of said locking jaw means whereby said positioning bar can be placed in any one of many positions to enable the user to practice a variety of golf swings.

2. A portable golf swing practice device as defined in claim 1 wherein said abutting flutes are formed by longitudinally extending spaced ribs with valleys between adjacent ribs.

3. A portable golf swing practice device as defined in claim 2 wherein said locking jaw means cooperates with said longitudinally spaced ribs to securely position said locking jaw means on said vertical guide post.

4. A portable golf swing practice device as defined in claim 3 wherein said locking jaw means allows vertical and rotational adjustment of said positioning bar relative to said vertical guide post.

5. A portable golf swing training device as defined in claim 3 wherein said ear portions of said locking jaw means are provided with apertures therethrough and a bolt is inserted through said apertures into a nut to firmly locate said jaw means relative to said guide post.

6. A portable golf swing practice device as defined in claim 5 wherein said positioning bar includes an aperture extending through one end thereof which, when aligned with said apertures in said ear portions also receives said bolt to secure said positioning bar relative to guide post.

7. A portable golf swing practice device as defined in claim 6 wherein said positioning bar is angularly adjustable relative to said guide post by means of said bolt and nut.

8. A portable golf swing practice as defined in claim 7 wherein all of said aforementioned components except said bolt and nut are made or rigid high strength polyvinylchloride to prevent corrosion.

9. A portable golf swing practice device as defined in claim 1 wherein said base means is weighted to provide stability to the entire device.

10. A portable golf swing practice device as defined in claim 1 wherein said vertical guide post and positioning bar are each provided with a plastic protective end cap.

* * * * *

UNITED STATES PATENT AND TRADEMARK OFFICE

CERTIFICATE OF CORRECTION

PATENT NO. : 5,303,926

DATED : April 19, 1994

INVENTOR(S) : Charles A. Owens, James A. Karr III

It is certified that error appears in the above-indentified patent and that said Letters Patent is hereby corrected as shown below:

On the Title Page, item 57, line 3, "flute", should read, "fluted"
line 10, "wring", should read, "swing"
line 11, "polyvingchlo-", should read, "polyvinylchlo-";
Column 4, line 66, the words, "base means", should preceed, "having";
Column 5, line 3, "flute", should read, "flutes";

Signed and Sealed this

Second Day of August, 1994

*Attest:*

Bruce Lehman

BRUCE LEHMAN

*Attesting Officer*

*Commissioner of Patents and Trademarks*